US011020715B2

(12) United States Patent
Chien

(10) Patent No.: US 11,020,715 B2
(45) Date of Patent: Jun. 1, 2021

(54) GAS-LIQUID DISSOLVING APPARATUS

(71) Applicant: TRUSVAL TECHNOLOGY CO., LTD., Miao-Li Hsien (TW)

(72) Inventor: Shih-Pao Chien, Miao-Li Hsien (TW)

(73) Assignee: TRUSVAL TECHNOLOGY CO., LTD., Miao-Li Hsien (TW)

( * ) Notice: Subject to any disclaimer, the term of this patent is extended or adjusted under 35 U.S.C. 154(b) by 222 days.

(21) Appl. No.: 16/389,495

(22) Filed: Apr. 19, 2019

(65) Prior Publication Data

US 2020/0330932 A1 Oct. 22, 2020

(51) Int. Cl.
*B01F 3/04* (2006.01)

(52) U.S. Cl.
CPC ..... *B01F 3/04248* (2013.01); *B01F 3/04262* (2013.01); *B01F 2003/04148* (2013.01); *B01F 2003/04319* (2013.01); *B01F 2003/04333* (2013.01); *B01F 2003/04361* (2013.01)

(58) Field of Classification Search
CPC .... B01F 3/04; B01F 3/04262; B01F 3/04241; A61M 1/32
See application file for complete search history.

(56) References Cited

U.S. PATENT DOCUMENTS 5,626,819 A * 5/1997 Novello ..... A61M 1/32 422/45

* cited by examiner

*Primary Examiner* — Robert A Hopkins
(74) *Attorney, Agent, or Firm* — Rabin & Berdo, P.C.

(57) ABSTRACT

The disclosure provides a gas-liquid dissolving apparatus, comprising: a sealed tank, a gas jet tube and a plurality of membrane plates; the sealed tank being provided with a liquid supply joint at top, and a gas inlet joint and an output joint at bottom; the gas jet tube being located inside the sealed tank and connected to the gas inlet joint; the gas jet tube having a plurality of gas jet holes distributed on tube wall; the plurality of membrane plates being stacked around the periphery of the gas jet tube and fixed; each membrane plate being ring-shaped, and being structured with an inner ring wall, a mixing chamber and an outer ring wall sequentially from the center; the mixing chamber having an opening facing downward, and the inner ring wall being thicker than the outer ring wall, with a gap existing between the two adjacent stacked outer ring walls.

9 Claims, 11 Drawing Sheets

GAS-LIQUID DISSOLVING APPARATUS

TECHNICAL FIELD

The technical field generally relates to a gas-liquid dissolving apparatus, in particularly, to a sealed tank forming a plurality of mixing chambers to increase the total contact area of the liquid and the gas, prolong the bubble residence time, and improve the dissolution efficiency.

BACKGROUND

The current apparatus for dissolving a gas a liquid is usually assisted by a diffuser or a Venturi tube. As shown in FIG. 1A, the apparatus for dissolving a gas in a liquid using a diffuser includes a high-pressure gas supply bottle 11, a tank 12, and a diffuser 13 installed in the tank 12. The tank 12 is provided with a liquid inflow pipe 121, a liquid outflow pipe 122, and an exhaust pipe 123 for allowing liquid to enter the tank to output a gas solution with high concentration of the gas. The high-pressure gas supply bottle 11 is connected to a gas pipe 14 to the diffuser 13. The diffuser 13 can generate a large amount of very fine bubbles in the incoming gas, and use fine bubbles to increase the gas-liquid contact area during the rising time of the bubble to increase the efficiency of the gas dissolved in the liquid and obtain a high concentration gas solution. In addition, when the tank 12 has too much gas or the pressure is too large, the gas can be exhausted through the exhaust pipe 123. However, this apparatus has some disadvantages when used:

1. The time that the bubble stays in the liquid is too short, resulting in insufficient dissolution. If the residence time is to be extended, the longitudinal height of the tank 12 must be lengthened, which causes the tank volume to be too large and takes up space.
2. The total area of gas-liquid contact cannot be greatly increased, resulting in insufficient dissolution.

FIG. 1B is an apparatus for dissolving a gas in a liquid using a Venturi tube. The Venturi tube 21 includes a liquid inflow pipe 211, a liquid outflow pipe 212, and a gas inlet pipe 213. The liquid inflow pipe 212 is further connected to an infusion pipe 22 and a pump 23 to allow liquid to be sent into the Venturi tube 21. The gas to be dissolved in the liquid is mixed with the liquid through the gas inlet pipe 213 to be dissolved. The principle of the device is: using high-pressure water to flow through the constricted section (called choke) of the inner pipe to generate a high-speed jet, causing a negative pressure to suck the gas into the choke, mixed with the high-speed jet liquid for dissolution, and the outflow contains a dissolved gas solution. However, the disadvantages of this structure include that the amount of added gas is controlled by the liquid flow rate, which has a small adjustable range, the resulting bubbles are large, the contact area is relatively small, and the mixing efficiency is low.

SUMMARY

The object of the present invention provides a gas-liquid dissolving apparatus with high dissolving efficiency, mainly by stacking a plurality of membrane plates in a sealed tank to form a plurality of specific spaces for mixing gas and liquid, thereby increasing the total surface area of the gas and prolonging the bubble residence time. Under the conditions of increased contact area and prolonged time, the efficiency of dissolving the gas in the liquid is significantly improved.

To achieve the above object, the present invention provides a gas-liquid dissolving apparatus, comprising: a sealed tank, a gas jet tube and a plurality of membrane plates; the sealed tank being provided with a liquid-supply joint at top, and a gas inlet joint and an output joint at bottom; the gas jet tube being located inside the sealed tank, with a top end closed and a bottom portion connected to the gas inlet joint; the gas jet tube has a plurality of gas jet holes distributed on tube wall; the plurality of membrane plates being stacked around the periphery of the gas jet tube and fixed; each membrane plate having a ring shape, and being structured with an inner ring wall, a mixing chamber and an outer ring wall sequentially from the center; the mixing chamber having an opening facing downward, and the inner ring wall being thicker than the outer ring wall, so that a gap existing between the outer ring walls of two adjacent stacked membrane plates; the inner ring wall being axially provided with at least an axial passage, and provided at different radial positions with at least a radial passage and at least a gas passage respectively; the radial passage communicating with the axial passage and the mixing chamber; the gas passage corresponding to the gas jet holes and communicating with the mixing chamber.

During the operation of the gas-liquid dissolving apparatus of the present invention, the liquid is injected from the liquid-supply joint at the top of the sealed tank, and fills the plurality of mixing chambers and the entire sealed tank through the axial passage and the radial passage. The gas is injected from the gas inlet joint at the bottom of the sealed tank, and is ejected through a plurality of gas jet holes of the gas jet tube, and is guided through the gas passage to cause fine bubbles to fill the mixing chamber to prolong the bubble residence time. In addition, the up to 10 layers of membrane plates with mixing chambers greatly increase the total surface area of the fine bubbles in contact with the liquid, thereby increasing the gas-liquid dissolution rate and the amount of dissolution.

The plurality of the gas jet holes of the gas jet tube of the present invention are divided into a plurality of groups according to being located at different heights, and the plurality of the gas jet holes of the same group are distributed at an equal angular interval at the same height on the tube wall, a plurality of gas passages are radially disposed on the inner ring wall, and the plurality of gas jet holes of the same group correspond to the plurality of gas passages of the membrane plate.

Furthermore, the outer diameter of the membrane plate is smaller than the inner diameter of the sealed tank, and the center has a central hole. The central hole is matched to the shape and size of the gas jet tube. The plurality of the axial flow channels are connected to the central hole at equal angles. When the plurality of the membrane plates are stacked and sheathed to surround the outer periphery of the gas jet tube, the vertically adjacent axial passages serve as a passage for the liquid to flow. The radial passage and the gas passage are all concave passages with downward openings, and are distributed at an equal angular interval on the inner ring wall in an interleaved manner. The radial flow channel has greater width and depth than the gas passage, whereby fine bubbles ejected by the gas jet hole are distributed in the mixing chamber through the gas passage, and the liquid is ejected through the radial passage to generate a jet liquid flow to the mixing chamber. The jet liquid flow, in addition to further dispersing the bubbles to make the bubbles finer for increasing the contact area, also prevents the bubbles from stopping to flow and accumulating in the mixing chamber, thereby affecting the gas-liquid dissolution operation.

The foregoing will become better understood from a careful reading of a detailed description provided herein below with appropriate reference to the accompanying drawings.

BRIEF DESCRIPTION OF THE DRAWINGS

The embodiments can be understood in more detail by reading the subsequent detailed description in conjunction with the examples and references made to the accompanying drawings, wherein.

DETAILED DESCRIPTION OF THE DISCLOSED EMBODIMENTS

Figure 1A:
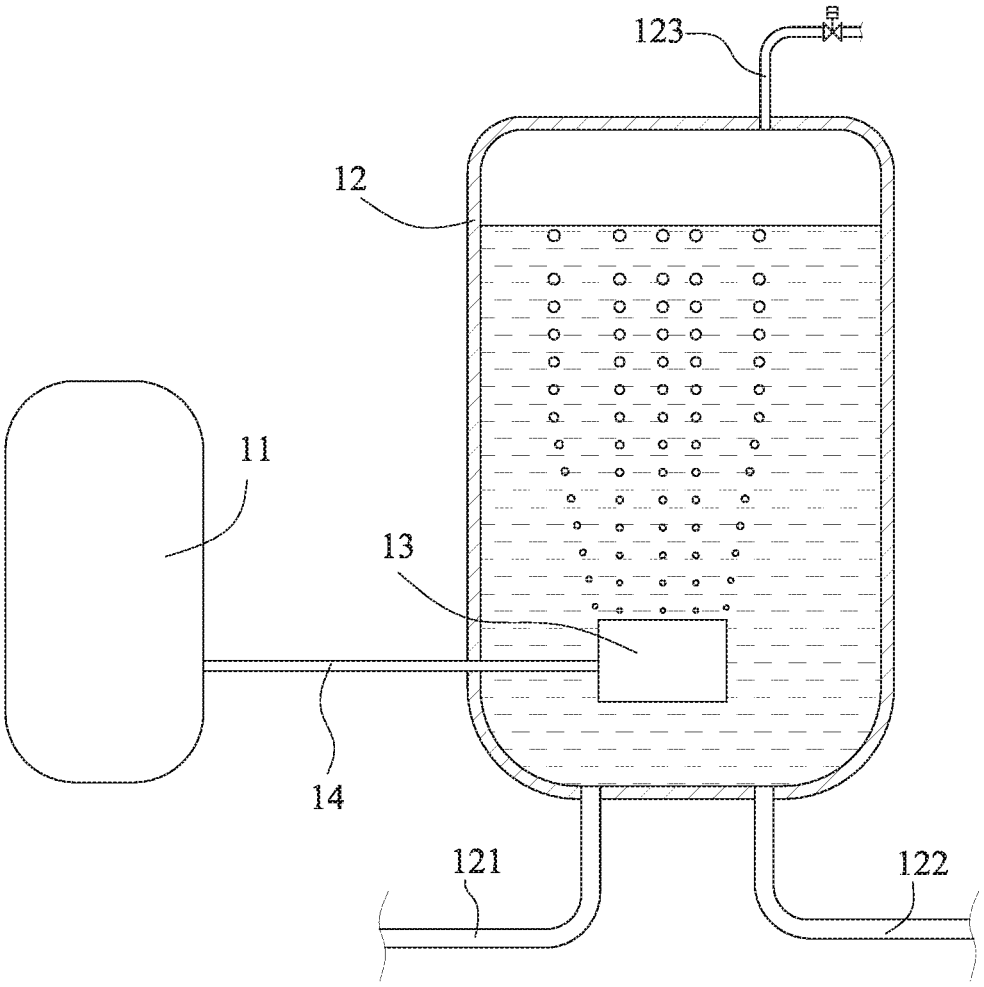
FIG. 1A is an apparatus for dissolving gas in liquid by using diffuser.
Figure 1B:
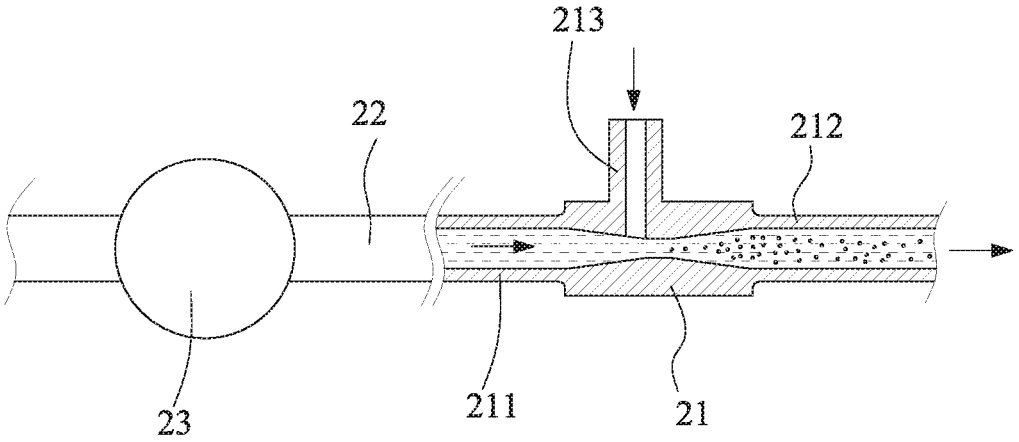
FIG. 1B is an apparatus for dissolving gas in liquid by using Venturi tuber.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
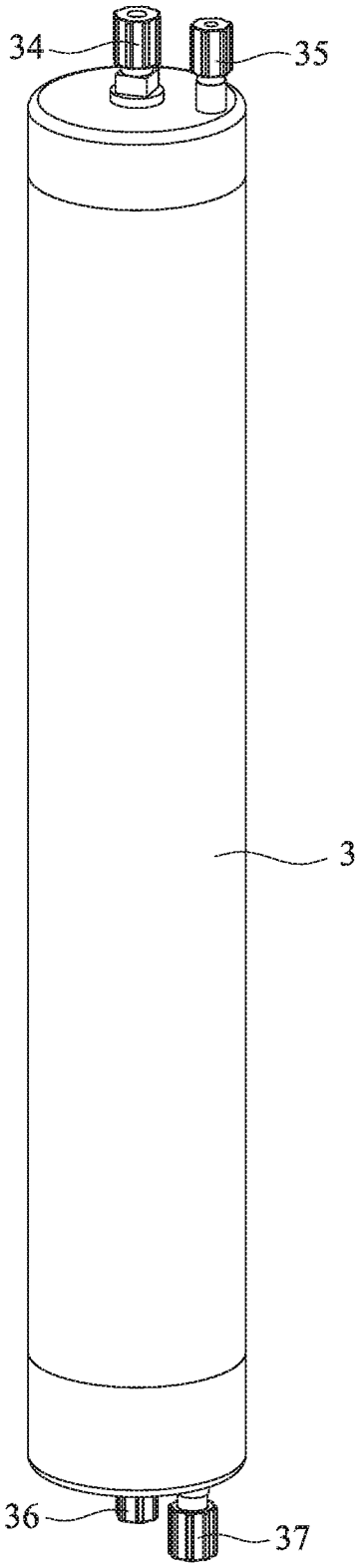
FIG. 2 is a schematic view showing the gas-liquid dissolving apparatus of the present invention.
Figure 3:
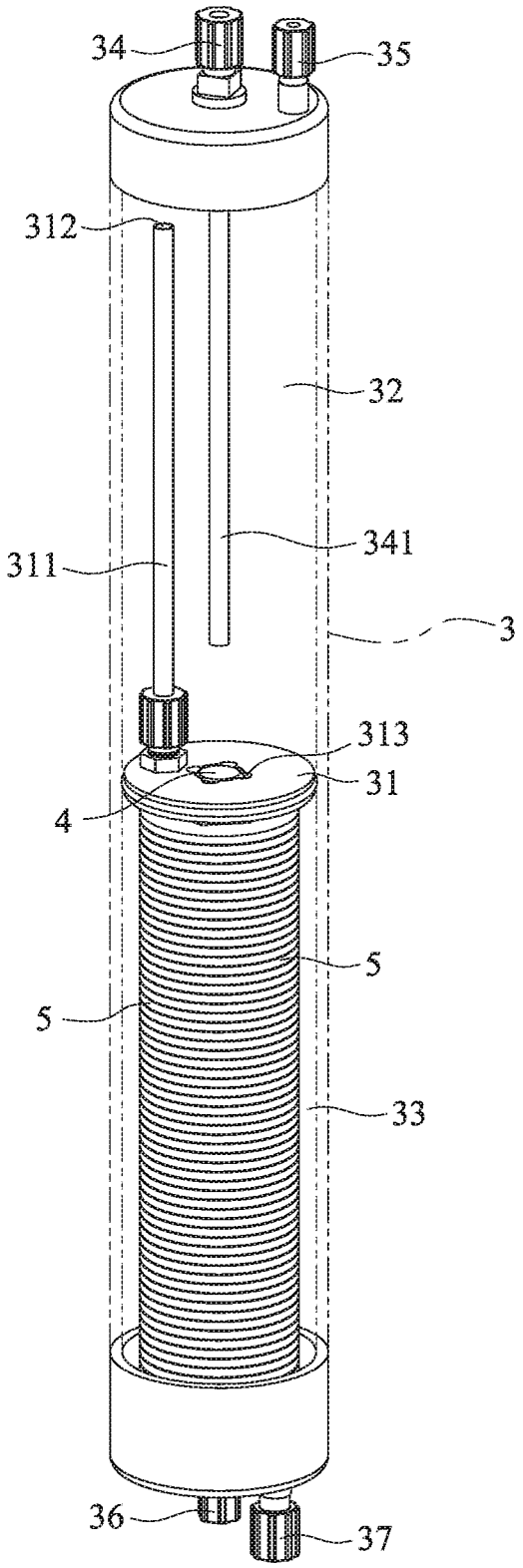
FIG. 3 is a schematic view showing the internal structure of the gas-liquid dissolving apparatus of the present invention.
Figure 4:
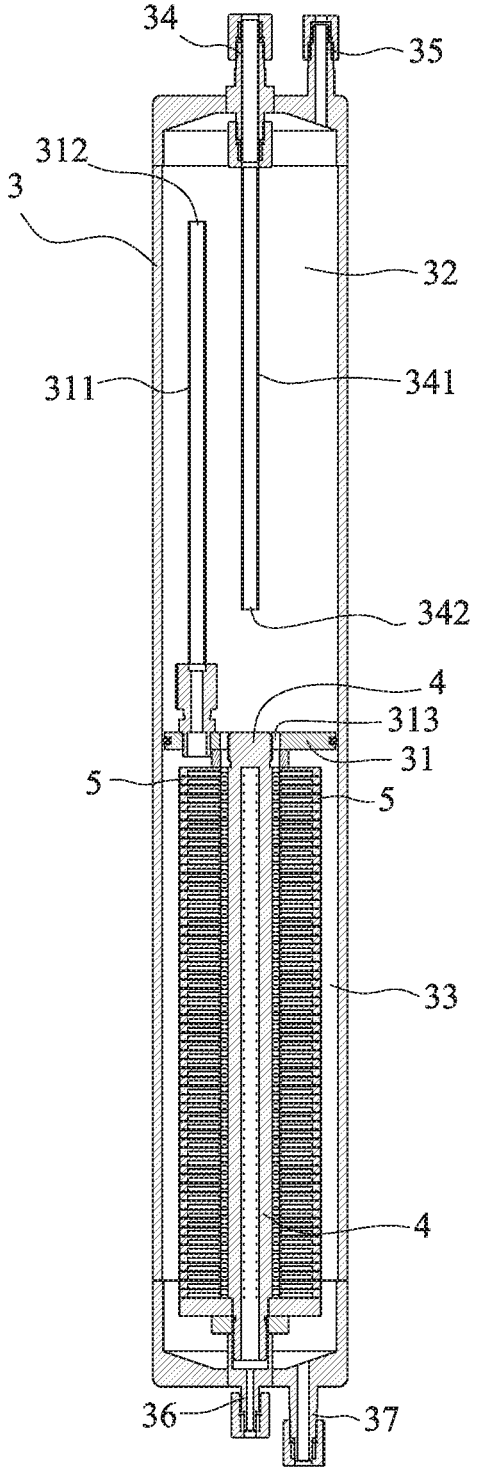
FIG. 4 is a cross-sectional view of the gas-liquid dissolving apparatus of the present invention.

FIG. 2, FIG. 3 and FIG. 4 show a schematic view, a internal structure view and a cross-sectional view of a gas-liquid dissolving apparatus of the present invention, respectively. The gas-liquid dissolving apparatus of the present invention includes a sealed tank, a jet tube 4 and a plurality of membrane plates 5. The plurality of membrane plates 5 are placed in a stacked manner around the periphery of the jet tube 4 and are fixed inside the sealed tank 3.

The sealed tank 3 is a long cylindrical container with closed surrounding wall, with a partition member 31 disposed inside. The partition member 31 partitions the inside of the sealed tank 30 into an upper space 32 and a lower space 33. The jet tube 4 and the plurality of membrane plates 5 are located in the lower space 33, where is the working area for main liquid-gas mixing and dissolving, and is also the design focus of the present invention, which will be described in detail later.

Although the partition member 31 is located at the middle of the sealed tank 3, the partition member 31 does not completely block the passage of gas and liquid between both spaces. A gas guiding tube 311 is disposed at non-central area of the partition member 31, and is located in the upper layer space 32 but still communicates with the lower layer space 33. The gas guiding tube 311 has a gas outlet 312 located in the upper layer area of the upper layer space 32. The partition member 31 is disposed with at least an axially penetrating first liquid flow passage 313 in central area. The first liquid flow passage 313 supplies liquid to the lower space 33, or more precisely, the first liquid flow passage 313 supplies liquid to the central area of the plurality of membrane plates 5, and then passes through the gap between the adjacent two membrane plates to fill the entire lower space 33. In the present embodiment, the partition member 31 is coupled to the top end of the gas jet tube 4 and fixed by screwing.

The top of the sealed tank 3 is provided with a liquid supply joint 34 and a pressure relief joint 35, and the two joints communicate with the upper space 32. The liquid supply joint 34 is for connecting an external liquid supply tube to supply the liquid into the sealed tank 3 from top down. A liquid outlet tube 341 is further disposed inside the sealed tank 3 to connect to the liquid supply joint 34. The liquid outlet 342 of the outlet tube 341 is close to the first liquid flow passage 313. The pressure relief joint 35 is used to connect a tube for discharging excess gas or liquid at an appropriate timing to adjust the pressure in the sealed tank 3. A gas inlet joint 36 and an output joint 37 are disposed at the bottom of the sealed tank 3. The gas inlet joint 36 communicates with the gas jet tube 4 in the sealed tank 3, and is connected to a gas supply tube to supply gas into the sealed tank 3 from bottom up. The output joint 37 is used for connecting a liquid supply tube, and the processed high-concentration gas solution is output through the output joint 37.

The following describes an operation mode of the present invention: the liquid is injected into the sealed tank 3 from the top through a liquid tube connected to the liquid supply joint 34, and maintains a preset pressure. The gas is ejected from the bottom via the gas supply tube through the gas supply tube connected to the gas inlet 36, and the gas-liquid mixing and dissolving operation is mainly performed among the plurality of the membrane plates 5 in the lower space 33. The subsequent high concentration gas solution is outputted through the liquid supply tube connected to the output joint 37 for use. However, the excess or undissolved gas in the process may flow through the gas guiding tube 311 to the upper layer area of the upper space 32 by buoyancy to prevent gas bubbles from being accumulated in the lower space 33, thereby affecting the progress of the dissolution reaction. When the pressure in the sealed tank 3 is higher than a preset value, gas or liquid is discharged through a tube connected to the pressure relief joint 35 for the purpose of reducing pressure.

Figure 5:
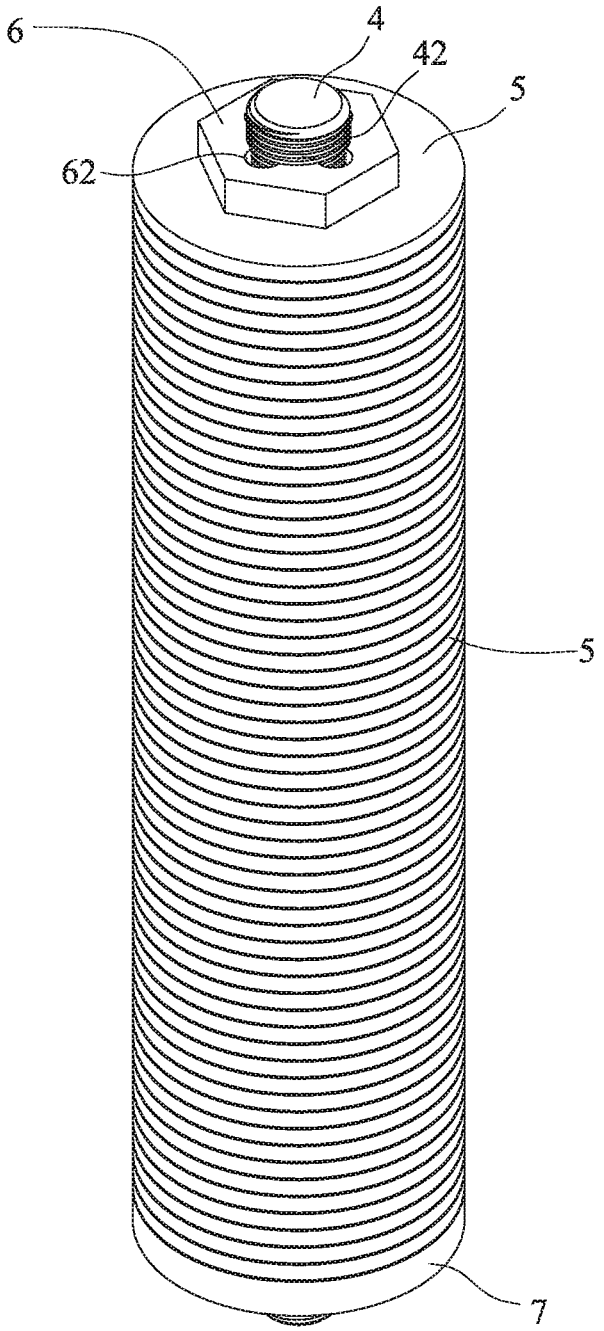
FIG. 5 is a schematic view after combining the gas jet tube and the membrane plates of the present invention.
Figure 6:
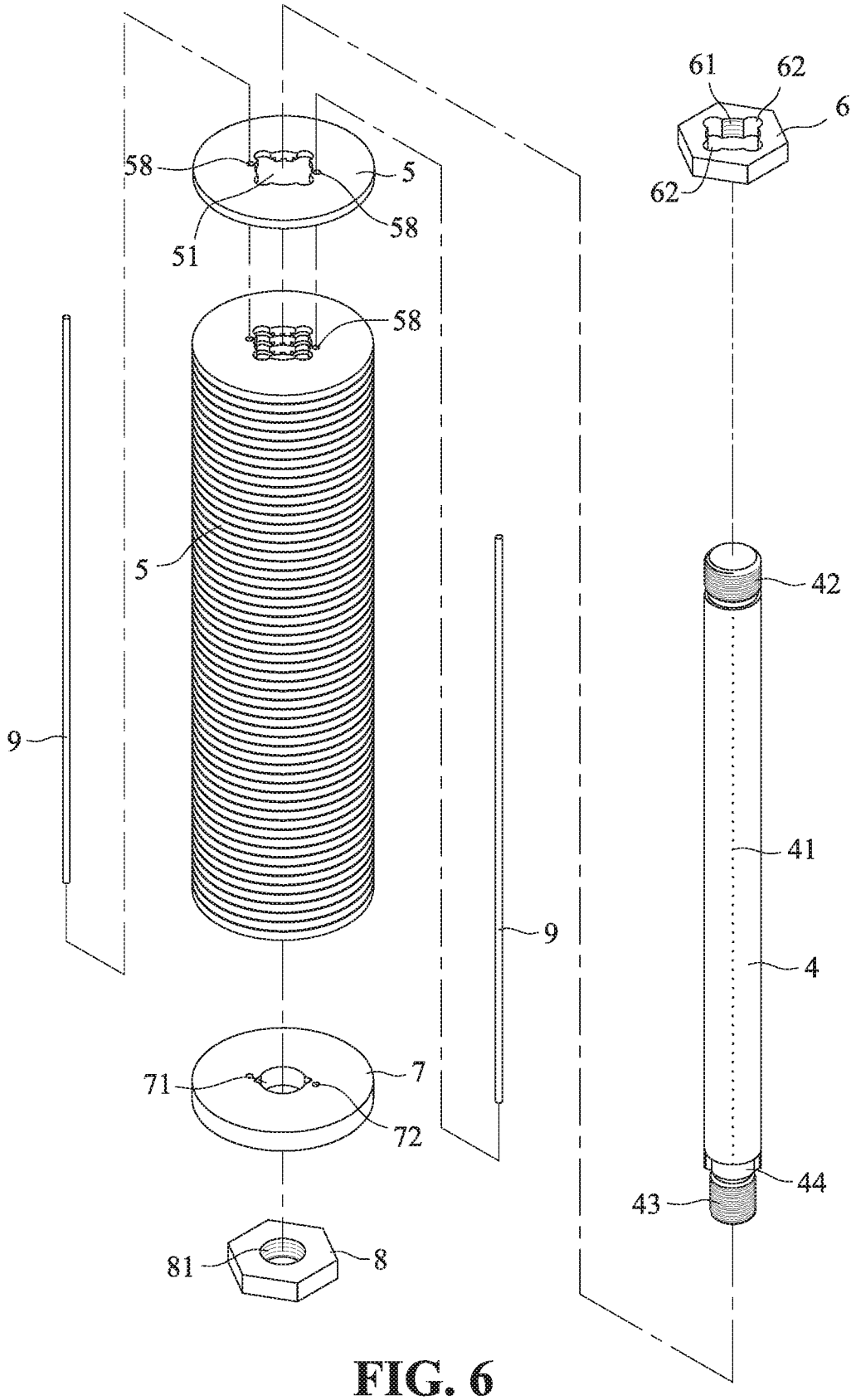
FIG. 6 is an exploded view of the gas jet tube and the membrane plates of the present invention.

The gas-liquid mixing and dissolution operation of the present invention is mainly performed among the plurality of membrane plates 5 fixed to the periphery of the gas jet tube 4. The following explains the structure of this part. The plurality of the membrane plates 5 are sleeved over the periphery of the gas jet tube 4. This manner of attachment can be achieved by a number of configurations, and the present invention is described by only one of embodiments, and does not limit the scope of the invention. As shown in FIGS. 5 and 6, the members fixed to the gas jet tube 4 sequentially includes an upper nut 6, the plurality of membrane plates 5, a fixing plate 7, and a lower nut 8.

The gas jet tube 4 is a hollow circular tube with a closed top end (see also FIG. 4), and a plurality of gas jet holes 41 are distributed in the tube wall. The pore size of the gas jet hole 41 is small to facilitate the ejection of many fine bubbles in the liquid. The plurality of gas jet holes 41 can be divided into a plurality of groups according to the height of the plurality of gas jet holes 41. The plurality of gas jet holes 41 of the same group is distributed at the same height and same angular intervals on the wall of the gas jet tube 4. In the embodiment, the same height position has four gas jet holes 41 and the four jet holes 41 are spaced at an angle of 90 degrees. The number of groups of the plurality of gas jet holes 41 of different heights is the same as the number of the plurality of the membrane plates 5, and the positions also correspond to one another. The outer wall of the upper and lower ends of the gas jet tube 4 has a first external thread 42 and a second external thread 43 respectively, and the upper edge of the second external thread 43 has a positioning portion 44 having a smaller outer diameter. The outer wall of the positioning section 44 is not circular.

The upper nut 6 has an internally threaded hole 61 at the center for screwing to the first external thread 42. The central area of the upper nut 6 further includes at least a second liquid flow passage 62. The second liquid flow passage 62 has a concave opening communicating with the internally threaded hole 61. The plurality of second liquid flow passages 62 are distributed at equal angular intervals in the internally threaded holes 61. When the upper nut 6 is locked to the first external thread 42, the space of the second liquid flow passage 62 existing in the axial direction allows the liquid to circulate.

Figure 7:
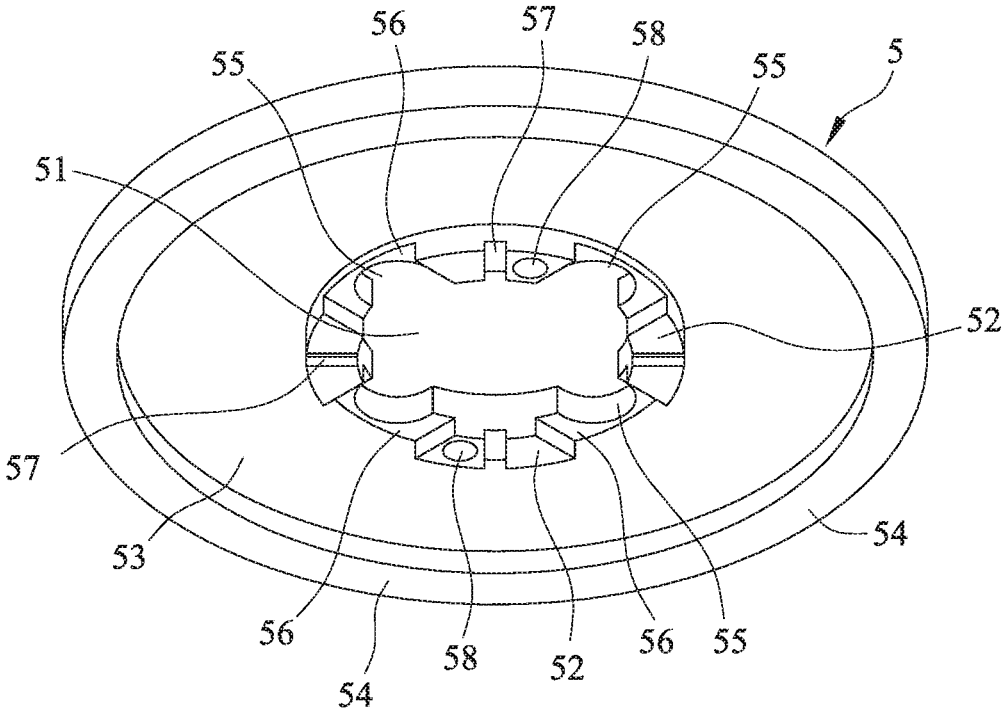
FIG. 7 is an enlarged bottom view of the membrane plate of the present invention.

The shapes of the plurality of membrane plates 5 are the same. Now, only a single membrane plate 5 will be described. As shown in FIG. 7, the membrane plate 5 is ring in shape to match the inner shape of the sealed tank 3, but the outer diameter of the membrane plate 5 is smaller than the inner diameter of the sealed tank 3, and has a central hole 51 in the center, and the central hole 51 is matched with the shape and size of the gas jet tube 4. The membrane plate 5 includes an inner ring wall 52, a mixing chamber 53, and an outer ring wall 54 sequentially from the center outwards. The mixing chamber 53 is a recessed space with the opening facing downward. The inner ring wall 52 is thicker than the outer ring wall 54. After the two adjacent membrane plates 5 are stacked, a gap exists between the adjacent two outer ring walls 54 for allowing excess gas bubbles and liquid to flow out. The mixing chamber 53 has a concave shape in order to extend the time during which the fine bubbles stay in the mixing chamber 53 to increase the dissolving the gas in the liquid. The axial direction of the central portion of the inner ring wall 52 is further provided with at least an axial passage 55, and the plurality of axial passages 55 are equiangularly connected to the central hole 51. The inner ring wall 52 is provided with at least a radial passage 56 and at least a gas passage 57 at different positions in the radial direction. The top wall in the mixing chamber 53 is higher than the radial passage 56 and the gas passage 57. In the present example, there are four radial passages 56 and are equiangularly distributed. The radial passage 56 is responsible for communicating the axial passage 55 with the mixing chamber 53. There are four equiangularly distributed gas passages 57. When assembled, the gas passage 57 corresponds to the gas jet hole 41 and communicates with the mixing chamber 53. The radial passage 56 and the gas passage 57 are all concave passages whose openings are all downward, and are distributed at an equal angular interval interleaved on the inner ring wall 52. The radial passage 56 has a greater width and depth than the gas passage 57. In addition, the inner ring wall 52 is provided with at least a first positioning hole 58 extending in the axial direction, and two positioning holes 58 are provided in this embodiment.

The fixing plate 7 is located below the bottommost layer of the plurality of membrane plates 5, so that the membrane plates 5 located at the bottom layer also can mix gas and liquid. The fixing plate 7 has the same outer shape as the membrane plates 5, but the intermediate dimension has an elliptical tapered hole 71 smaller than the central hole 51, and the elliptical tapered hole 71 is the match the outer wall of the positioning section 44 of the gas jet tube 4. The positioning section 44 is located at the upper edge of the second external thread 43. In addition, the fixing plate 7 is provided with at least a penetrating second positioning hole 72 in the axial direction, and two second positioning holes 72 are provided in this embodiment.

The present invention further is provided with two positioning posts 9, which can respectively pass through the first positioning holes 58 of the plurality of the membrane plates 5 and the second positioning holes 72 of the fixing plate 7, thereby maintaining the relative positions of the plurality of membrane plates 5. The lower nut 8 has an inner threaded hole 81 at the center thereof for locking to the second external thread 43 of the gas jet tube 4.

During assembly, the plurality of membrane plates 5 and the fixing plate 7 are stacked on the periphery of the gas jet tube 4, and the positioning post 9 is inserted into the plurality of first positioning holes 58 and the second positioning hole 72 to ensure the relative positions of the plurality of membrane plates 5 and the fixing plate 7 are respectively locked to the two ends of the gas jet tube 4 to achieve the overall fixing. Then, the structure is assembled into the sealed tank 3. For example, the bottom of the gas jet tube 4 is further connected to the gas inlet joint 36, and the first external thread 42 at the top end of the gas jet tube 4 can be screwed to the center of the partition member 31.

Figure 8:
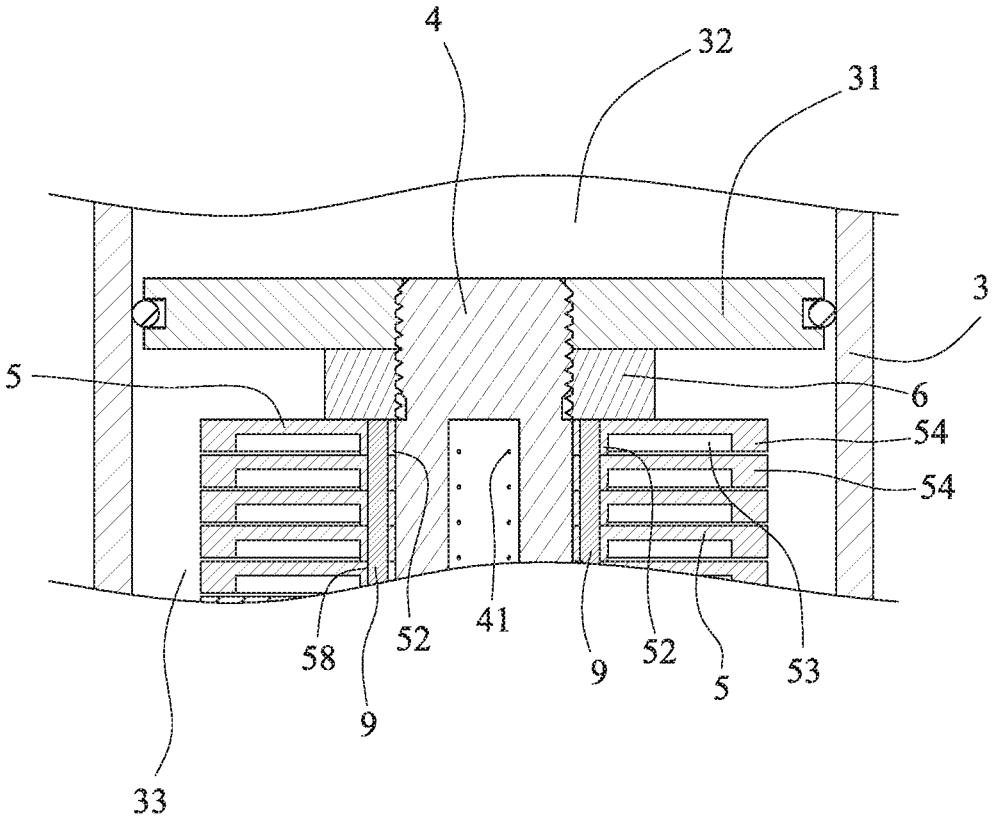
FIG. 8 is the first enlarged schematic view of a partial longitudinal cross-section of the present invention, which is a longitudinal cross-sectional view of the position of the positioning post.
Figure 9:
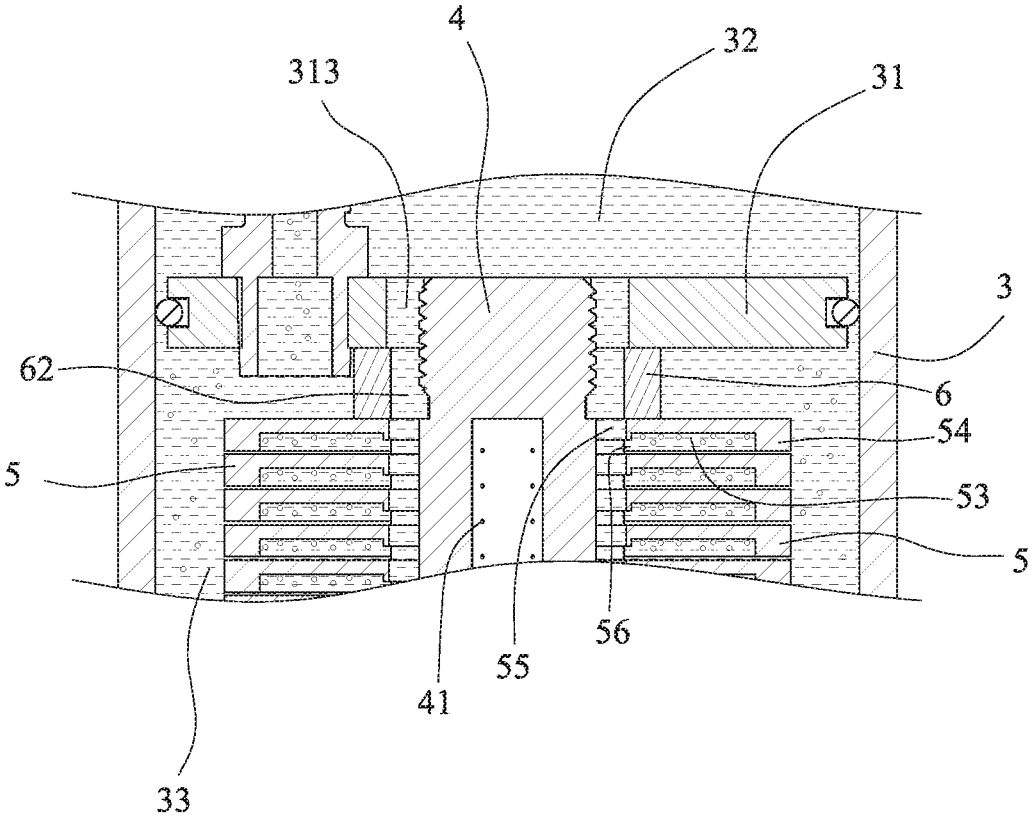
FIG. 9 is the second enlarged schematic view of a partial longitudinal cross-section of the present invention, which is a longitudinal cross-sectional view of the position of the radial passage.
Figure 10:
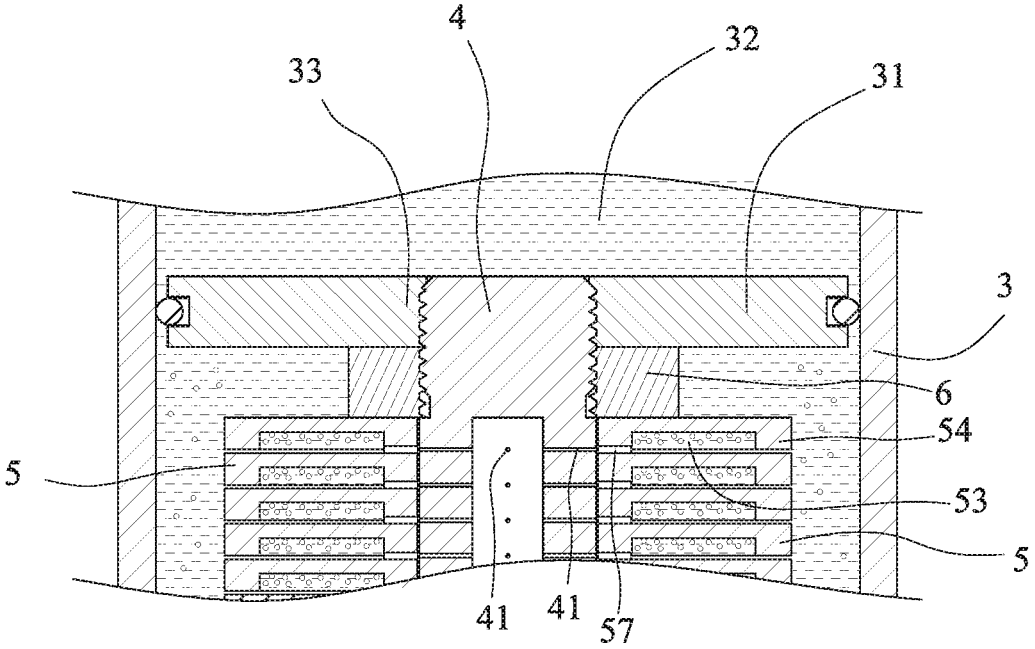
FIG. 10 is the third enlarged schematic view of a partial longitudinal cross-section of the present invention, which is a longitudinal cross-sectional view of the position of the gas passage.

The following describes the actual operation and principle of the present invention. In order to avoid the over-complicated drawing, only 3-4 membrane plates 5 are shown to be stacked and fixed on the gas jet 4, while up to several tens of membrane plates 5 are actually disposed. FIG. 8 is a longitudinal cross-sectional view showing the position of the positioning post 9. FIG. 9 is a longitudinal cross-sectional view of the radial passage 56, which is the liquid flow passage. FIG. 10 is a longitudinal cross-sectional view of the gas passage 57, which is the gas flow passage.

As shown in FIG. 8, the membrane plates 5 are placed in a stack on the periphery of the gas jet tube 4. The positioning post 9 penetrates the first positioning hole 58 of each of the membrane plates 5 and the second positioning hole 72 of the fixing plate 7 at the bottom layer to ensure that the plurality of membrane plates 5 are in the correct orientation. Since the inner ring wall 52 is thicker than the outer ring wall 54, the adjacent two membrane plates 5 are stacked with a gap between adjacent outer ring walls 54.

As shown in FIG. 9, the liquid flow direction is from the top to the bottom inside the sealed tank 3, and the entire lower layer space 33 is filled outward from the center. The detailed flow direction is: after the liquid fills the upper space 32 of the sealed tank 3, the first liquid flow passage 313 passing through the partition member 31, the second liquid flow passage 62 of the upper nut 6, the axial passage 55 and the radial passage 56 of the membrane plate 5 to fill the entire mixing chamber 53. Excess liquid flows out through the gap to fill the remaining space of the entire lower space 33.

As shown in FIG. 10, the gas is ejected into the sealed tank 3 from below, and the flow direction thereof is: passing through the inside of the gas jet tube 4, the plurality of gas jet holes 41 on the tube wall, and the gas passage 57 of the membrane plate 5 to the mixing chamber 53. The dissolved gas-liquid solution or excess bubbles are discharged through the gap. The bubbles are raised by the buoyancy, and the gas-liquid solution is outputted through a tube connected to the output joint 37. In the present invention, since the diameter of the gas jet hole 41 is extremely small, after the high-pressure gas is ejected through the gas jet hole 41 and aligned with the gas passage 57, fine bubbles are generated in the mixing chamber 53, and the contact area between the bubbles and the liquid is increased. The concave portion of the mixing chamber 53 can extend the time the bubbles staying inside the mixing chamber 53, thereby increasing the gas-liquid dissolution. In addition, the liquid is ejected through the radial passage 56 to generate a liquid jet to the mixing chamber 53. The liquid jet, by further dispersing the bubbles to make the bubbles finer, increases the contact area, and prevents the bubbles from stopping to flow and to accumulate inside the mixing chamber 53 to affect the progress of the gas-liquid dissolution. Due to the tens of layers of the membrane plates 5 in the sealed tank 3, the total contact area is relatively increased by tens of times, and the overall dissolution is also greatly improved.

In summary, the gas-liquid dissolving apparatus of the present invention is disposed with a plurality of membrane plates 5 in a stacked manner on the periphery of the gas jet tube 4 inside the sealed tank 3 to form up to tens of stacked mixing chambers. In a high pressure state, the liquid is supplied from the top and the gas is ejected from the bottom, and the fine bubbles in the mixing chamber 53 continuously stays in contact with the liquid with a large area and prolong the contact time, so that the gas is dissolve into the liquid, and a large amount of high-concentration gas-liquid solution is generated.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A gas-liquid dissolving apparatus, comprising:

a sealed tank, provided with a liquid-supply joint at top, and a gas inlet joint and an output joint at bottom;

a gas jet tube, located inside the sealed tank, with a top end closed and a bottom portion connected to the gas inlet joint; the gas jet tube having a plurality of gas jet holes distributed on a tube wall; and a plurality of plates, stacked around a periphery of the gas jet tube and fixed; each plate having a ring shape, and being structured with an inner ring wall, a mixing chamber and an outer ring wall sequentially from a center; the mixing chamber having an opening facing downward, and the inner ring wall being thicker than the outer ring wall, so that a gap exists between the outer ring walls of two adjacent stacked plates; the inner ring wall being axially provided with at least an axial passage, and provided at different radial positions with at least a radial passage and at least a gas passage respectively; the radial passage communicating with the axial passage and the mixing chamber; the gas passage corresponding to the plurality of gas jet holes and communicating with the mixing chamber.

2. The gas-liquid dissolving apparatus as claimed in claim 1, wherein the plurality of the gas jet holes of the gas jet tube are divided into a plurality of groups in accordance with being located at different heights on the tube wall, and a plurality of the gas jet holes of a same group are distributed at an equal angular interval at a same height on the tube wall, a plurality of gas passages are radially disposed on the inner ring wall, and the plurality of gas jet holes of the same group correspond to the plurality of gas passages of the plate.

3. The gas-liquid dissolving apparatus as claimed in claim 1, wherein the sealed tank is disposed with a partition member inside; the partition member partitions the inside of the sealed tank into an upper space and a lower space; the partition member is engaged to the top end of the gas jet tube and the plurality of plates are located in the lower space; the partition member is disposed with at least a penetrating first liquid passage at a center, and the first liquid passage communicates with the axial passage; the partition member is further disposed with a gas guiding tube, located in the upper space and communicating with the lower space; the top of the sealed tank is connected to a pressure relief joint.

4. The gas-liquid dissolving apparatus as claimed in claim 1, wherein the plate has an outer diameter smaller than an inner diameter of the sealed tank, and the center of the plate has a central hole, the central hole is matched with a shape and size of the gas jet tube, and a plurality of axial passages are connected to the central hole at equal angle intervals; when the plurality of the plates are stacked on the periphery of the gas jet tube, axial passages adjacent to each other serve as a passage for the liquid to flow.

5. The gas-liquid dissolving apparatus as claimed in claim 1, wherein the radial passage and the gas passage are all concave passages with openings facing downward, and are distributed at an equiangular interval to the inner ring wall, but the radial passages are both greater in depth than the gas passages.

6. The gas-liquid dissolving apparatus as claimed in claim 1, wherein the gas jet tube is sequentially combined, from top to bottom, with an upper nut, the plurality of the plates, a fixing plate and a lower nut; the gas jet tube has a first external thread and a second external thread respectively on an outer wall of upper and lower ends, the upper nut is screwed to the first external thread, and the lower nut is screwed to the second external thread, so that the plurality of the plates and the fixing plate are fixed to an outer periphery of the gas jet tube.

7. The gas-liquid dissolving apparatus as claimed in claim 6, wherein a center portion of the upper nut further is disposed with at least a second liquid passage in communication with the axial passage.

8. The gas-liquid dissolving apparatus as claimed in claim 6, wherein the inner ring wall is disposed with a plurality of first positioning holes extending in an axial direction, and the fixing plate is also disposed with at least a second positioning hole penetrating through, and at least a positioning post is disposed through the plurality of the first positioning holes of the plates and the second positioning hole of the fixing plate to maintain relative positions of the plates.

9. The gas-liquid dissolving apparatus as claimed in claim 6, wherein the fixing plate has a same outer shape as the plate, has an elliptical tapered hole in a central area, and the elliptical tapered hole matches a positioning section of the gas jet tube, and the positioning section is located at an upper edge of the second external thread.

* * * * *